US006674232B2

(12) United States Patent
Opresko et al.

(10) Patent No.: US 6,674,232 B2
(45) Date of Patent: Jan. 6, 2004

(54) GETTER PLACEMENT AND ATTACHMENT ASSEMBLY

(75) Inventors: Stephen Thomas Opresko, Lancaster, PA (US); James Francis Edwards, Lancaster, PA (US); Kelly Eugene Hamm, Holtwood, PA (US); Lynn Adin Shively, Lancaster, PA (US)

(73) Assignee: Thomson Licensing S. A., Boulogne Cedex (FR)

( * ) Notice: Subject to any disclaimer, the term of this patent is extended or adjusted under 35 U.S.C. 154(b) by 397 days.

(21) Appl. No.: 09/735,878

(22) Filed: Dec. 13, 2000

(65) Prior Publication Data

US 2002/0070659 A1 Jun. 13, 2002

(51) Int. Cl.[7] ..... H01J 31/00; H01J 29/80

(52) U.S. Cl. ..... 313/481; 313/402; 313/407; 313/553

(58) Field of Search ..... 324/481, 553, 324/402, 407, 479, 560, 556, 561–562, 559

(56) References Cited

U.S. PATENT DOCUMENTS

| | | | | | |
|---|---|---|---|---|---|
| 4,145,162 | A | * | 3/1979 | Schiabel | 417/48 |
| 4,230,966 | A | * | 10/1980 | Compen | 313/481 |
| 4,602,187 | A | * | 7/1986 | Fischman et al. | 313/479 |
| 4,614,896 | A | * | 9/1986 | Josephs et al. | 313/481 |
| 4,622,490 | A | * | 11/1986 | Benway | 313/402 |
| 5,350,970 | A | | 9/1994 | Vennix et al. | 313/481 |
| 5,397,958 | A | * | 3/1995 | Na | 313/402 |
| 5,519,283 | A | | 5/1996 | Opresko et al. | 313/479 |
| 5,541,474 | A | | 7/1996 | LaPeruta et al. | 313/481 |

FOREIGN PATENT DOCUMENTS

| | | | | |
|---|---|---|---|---|
| EP | 0544351 A1 | | 11/1992 | H01J/29/94 |
| JP | 62272430 | | 11/1987 | H01J/29/94 |
| JP | 2-68843 | * | 3/1990 | |
| JP | 06089674 | | 3/1994 | H01J/29/94 |
| JP | 08227668 | | 9/1996 | H01J/29/02 |
| WO | WO0146983 A1 | | 6/2001 | H01J/29/88 |

* cited by examiner

*Primary Examiner*—Jay Patidar
(74) *Attorney, Agent, or Firm*—Joseph S. Tripoli; Joseph J. Laks; Carlos M. Herrera

(57) ABSTRACT

The present invention relates to a getter placement and attachment assembly for securing and placement of the getter along the major axis of a CRT. The getter placement and attachment assembly includes a getter spring for removably securing the getter to an internal magnetic shield affixed to the frame of the color selection electrode or mask frame of a CRT. The internal magnetic shield has sidewalls enclosures with a plurality of apertures therethrough along the major axis of the CRT to permit optimum deposition of a getter film within the CRT.

8 Claims, 2 Drawing Sheets

GETTER PLACEMENT AND ATTACHMENT ASSEMBLY

The present invention relates to the positioning of getters within a cathode-ray tube. More particularly, this invention relates to a getter placement and attachment assembly for securing and positioning getters along the major axis of a cathode-ray-tube (CRT).

BACKGROUND OF THE INVENTION

During the manufacture of a CRT, the ultimate vacuum is obtained through the use of getters that are primarily barium compound materials. Barium is flashed or vaporized by placing an RF coil near the outside wall of the CRT funnel adjacent the getter after the tube has been exhausted and sealed, where the RF energy from the activated coil vaporizes the getter material. The vaporized getter material absorbs and reacts with the residual gas molecules in the picture tube and removes them as low vapor pressure solid condensate and continues to absorb any further liberated gases throughout the life of the CRT.

It is a common practice to position the getter in the inside surface of the neck and yoke portions of the CRT attached to the electron gun. Since the getter holder containing the getter material must be outside the path of stream of electrons directed from the electron gun toward the viewing screen of the tube, and since the diameter of the funnel cross-section at the neck and yoke portions of the CRT is relatively small, it is known to locate the getter in the forward region of the tube envelope on screen related structures, such as the shadow mask frame or the exterior surface of the internal magnetic shields (IMS). Furthermore the position of getters in the neck and yoke regions of the tube are detrimental to operating tubes at the higher scan rates required for high performance tubes. Therefore, it is desired to remove the getter source from the neck and yoke regions, while still maintaining good getter pumping characteristics.

Cases in which the getters are attached to the exterior surface of the IMS, the IMS may have any number of configurations including imperforate structures so that the flashed getter material is accessible to the residual gas molecules within the CRT. However, this position of the getter on the exterior surface of the IMS can nevertheless result in getter flash deposit on the backside of the IMS thereby restricting the deposit of getter material from reacting with the gas molecules within the tube. Attaching the getter in the forward region of the tube, as in the case of the shadow mask frame, also reduces getter flash distribution due to its close proximity to the viewing screen of the tube. Consequently, an increase in localized gas pressure occurs and positively charged ions are generated by the collision between the electron beams and the gas molecules within the tube. The positively charged ions are accelerated toward the cathodes of the electron gun, where they bombard and deplete the cathode coatings, resulting in a reduction of cathode emission.

The problem associated with getter flash distribution is further aggravated in a larger size CRT. As the size of the CRT increases, a relatively larger amount of active barium material to react with the residual gas molecules is required. Moreover, as the aspect ratio of the CRT increases, the major or horizontal axis of the CRT increases thereby increasing the distribution distance of the flashed getter along the major axis of the CRT. Increased amounts of barium material may be placed within the CRT with larger or multiple getter holders, however, this configuration results in increased getter flash deposits on undesired areas of the CRT as described above, i.e., getter flash tends to deposit on the back side of the IMS. On the other hand, reducing the number of getters and positioning the getter holder to achieve a getter flash distribution that substantially avoids the IMS and neck regions of the tube also reduces the getter performance because the flashed getter material does not maintain a sufficiently low pressure within the CRT by absorbing the residual gas molecules therein. The lack of vacuum pressure within the CRT envelope is essential for adequate life of the CRT.

Thus, it is desired to have a getter placement and attachment assembly that provides optimum getter flash distribution within a CRT to permit the flashed getter material to react with the residual gas molecules within the CRT without depositing on undesired areas of the CRT.

SUMMARY OF THE INVENTION

The present invention relates to a getter placement and attachment assembly for securing and placement of the getter along the major axis of a CRT. The present invention provides optimum getter flash distribution within a CRT and finds particular utility in large size and large aspect ratio CRTs in which relatively large areas of getter distribution is desired.

As will be set forth in greater detail in the description of the preferred embodiment, the getter placement and attachment includes a getter spring for removably securing the getter to an internal magnetic shield affixed to the frame of the color selection electrode or mask frame of a CRT. The internal magnetic shield has sidewall enclosures with a plurality of apertures therethrough along the major axis of the CRT to permit optimum deposition of a getter film within the CRT.

BRIEF DESCRIPTION OF THE DRAWINGS

The invention will now be described in greater detail with relation to the accompany drawings in which.

DETAILED DESCRIPTION OF THE PREFERRED EMBODIMENT

Figure 1:
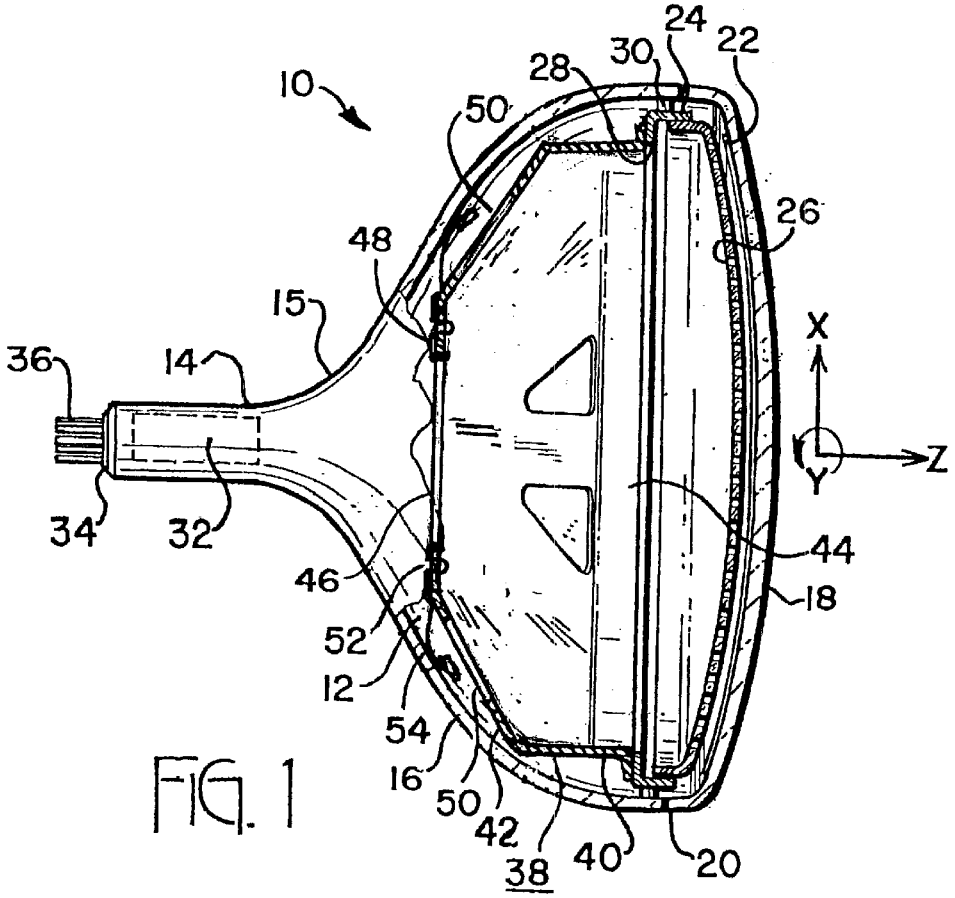
FIG. 1 is a cross-sectional view of the present invention within the CRT.

FIG. 1 shows a conventional color CRT 10, such as a television picture tube or a monitor tube, having an evacuated glass envelope 12 comprising a cylindrical neck portion 14 and a yoke region 15 extending from the small end of a funnel 16. The large end of the funnel 16 is closed by a faceplate panel 18, which is integrally joined at a frit seal line 20. A phosphor screen 22 is arranged on the inside surface of the faceplate panel 18. The phosphor screen 22 is composed of phosphor columns each of which emits one of the three primary colors of light when impacted by three electron beams. The envelope 12 has a central longitudinal tube axis Z—Z which passes through the faceplate panel 18, the funnel 16 and the neck portion 14. The tube has a plane perpendicular to the longitudinal axis Z—Z and includes two orthogonal axes; a major axis X—X, parallel to its wider dimension (usually horizontal), and a major axis Y—Y, parallel to its narrower dimension (usually vertical).

A mask-frame assembly 24, comprising an aperture color selection electrode or shadow mask 26 is attached to a peripheral frame 28. The mask-frame assembly 24 is removably mounted within the faceplate panel 18 and approximately perpendicular to the central longitudinal axis Z—Z in predetermined spaced relationship to the phosphor screen 22 by springs 30. The shadow mask 26 is spaced from the phosphor screen 22 and is used to direct the three electron beams to the phosphors, which emit the appropriate colors of light. An electron gun mount assembly, shown schematically at 32, is located within the neck portion 14 and provides the electron beams, which are used to scan the phosphors of the screen 22. The distal end of the neck portion 14 is closed by a stem 34 having terminal pins or leads 36 therethrough on which the mount assembly 32 is supported and through which electrical connections are made to various elements of the mount assembly 32.

The electrons are charged particles, and accordingly the electron beams are subject to deflection because of the influence of the Earth's magnetic field. Utilizing an internal magnetic shield (IMS) 38 minimizes the effects of the Earth's magnetic field. The IMS 38 is composed of a ferromagnetic material, such as cold rolled steel, which bends or redirects the magnetic field lines of the Earth around the electron beams to minimize the effects on the beams as they pass through apertures in the shield. This is an important feature because the electron beam deflection caused by the Earth's magnetic field can cause particular electron beam to hit a phosphor of the wrong light emitting color, thus resulting in misregistry and thereby degrading the quality of the image display. Additionally, when a television receiver including the tube is moved from one position to another, the relative position of the axis of the tube with respect to the Earth's magnetic field charges, thereby possibly causing substantial degradation of the image display because of additional misregistration of the electron beams.

Figure 2:
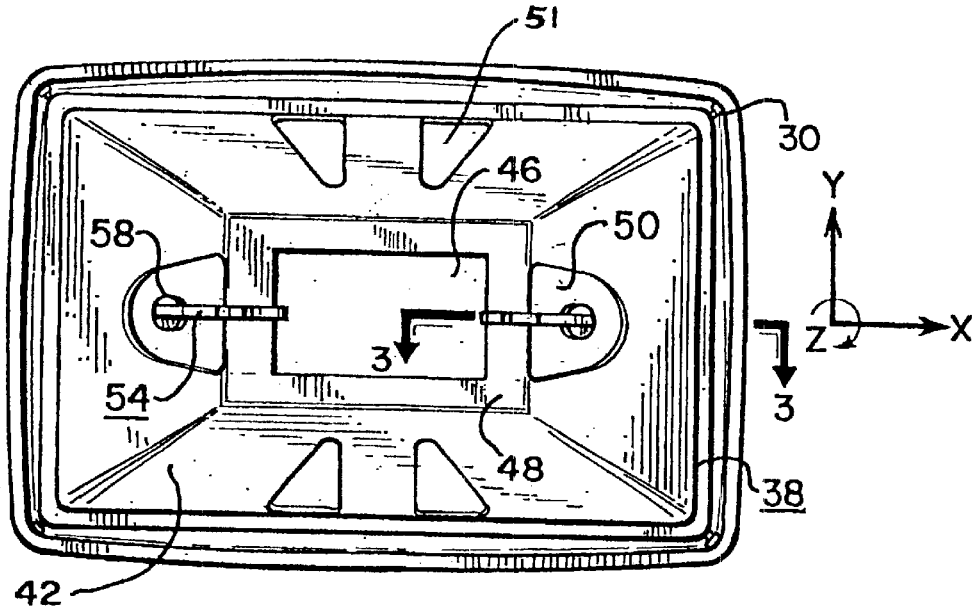
FIG. 2 is a plan view of the IMS and faceplate panel illustrating the getter attachment assembly secured to the IMS.

As shown in FIGS. 1 and 2, the IMS 38 lies within the interior surface of the funnel 16 and is securely attached to the rear portion of the mask-frame assembly 24 by attaching the L-shaped flanges 40 to the peripheral frame 28, as by welding or pinning. The IMS 38 of the present invention comprises a plurality of generally flat sidewalls 42 forming a generally truncated pyramidal shape and having a front open end 44, arranged in the proximity of the faceplate panel 18, and a rear open end 46, which is arranged remote from the faceplate panel 18 and faces the electron gun mount assembly 32. The rear open end 46 permits entry of the electron beams into the shield and is defined by a ledge 48 extending inward from the sidewall 42 toward axis Z—Z. The ledge 48 is formed with openings 52 to accept the getter attachment assembly 54 having an evaporable or flashable getter 58, as will be described in detail below. Referring now to FIG. 2 there is illustrated a plan view of the present invention viewed from the rear in the direction of axis Z—Z showing a plurality of apertures 50 formed through the sidewall 42 of the IMS 38. For clarity, the funnel 16 and electron gun mount assembly are not shown. The locations and size of the apertures 50 are shown as extending symmetrically from the outer perimeter of the ledge 48 toward the frame 28 and centered along the major axis X—X with the width of the apertures 50 being wider at the sides thereof facing the rear open end. The apertures 50 permit a film, or deposit, of gas-absorbing material from the getter 58, i.e., flashed getter material, to pass through the sidewall 42 of the IMS 38 and into the interior surface of the CRT 10. The size of the apertures 50 are also large enough so that the flashed getter material is not deposited onto the back side of the IMS 38 so as to restrict the deposit of getter material from reacting with the gas molecules within the CRT 10. The triangular apertures 51 are used to tune the magnetic field shaping characteristics of the IMS for the specific tube where it is being employed.

Figure 3:
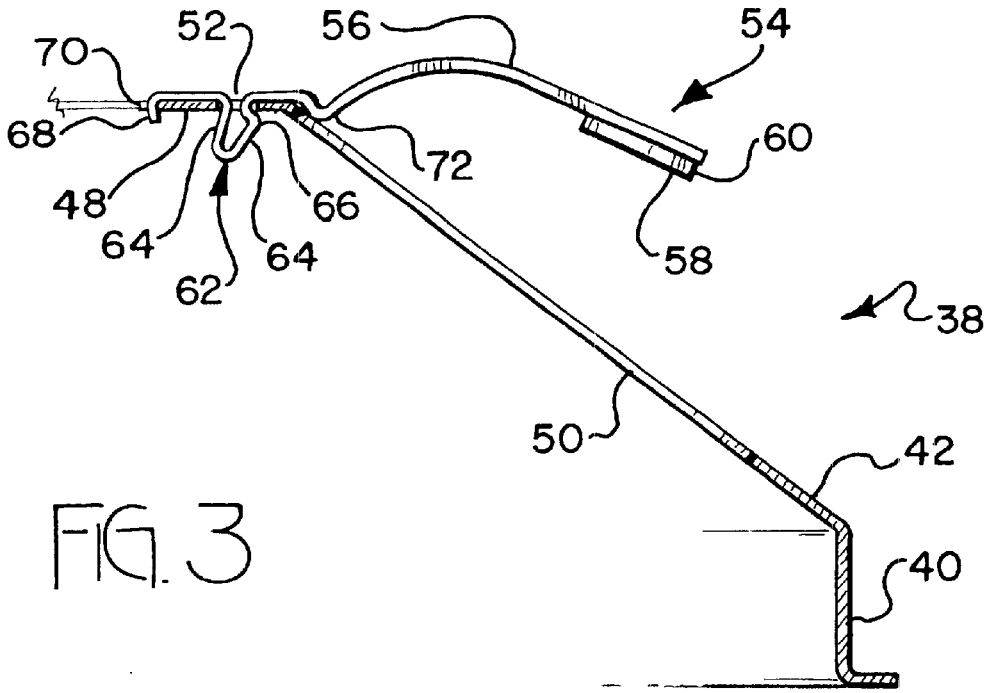
FIG. 3 is an enlarged partially broken-away side view taken at line 3—3 of FIG. 2 of the getter attachment assembly for attachment to the inside of the IMS.

Referring now to FIG. 3 in particular, there is shown an enlarged sectional view taken along section 3—3 of a portion of the IMS 38 of FIG. 2, presenting a side view of a getter attachment assembly 54. The getter attachment assembly 54 comprises an elongated spring 56, which is attached at its proximal end to the IMS 38 and extends in cantilever fashion so as to ensure the flashed getter material from the getter 58 is deposited through the apertures 50. The getter comprises a ring-shaped metal cup 60 attached to the distal end of the spring 56. The cup 60 has a U-shaped channel containing a gas-absorbing material with a closed base facing the inner wall of the funnel 16. At the proximal end of the spring 56 is a resilient fastening member, such as coupling clip 62. The coupling clip 62 has a substantially V-shaped portion 64, which is inserted into the opening 52 provided through the ledge 48 of the IMS 38. The clip 62 has shoulder 66 which contacts the underside of the ledge 48 and a grasping portion 68 formed to provide a projected corner for contact with the edge of notch 70 in the ledge 48. The spring 56 has an arcuate bend therein and an angled bend 72 formed to provide positioning pressure against the sidewall 42 during the positioning of the getter attachment assembly 54 on the IMS 38. The clip 62 provides coupling forces not only by the elastic force of the V-shaped portion 64, but also by the elastic forces of the grasping portion 68 and the angled bend 72 of the spring 56 so as to retain the clip 62 within the opening 52.

Figure 4:
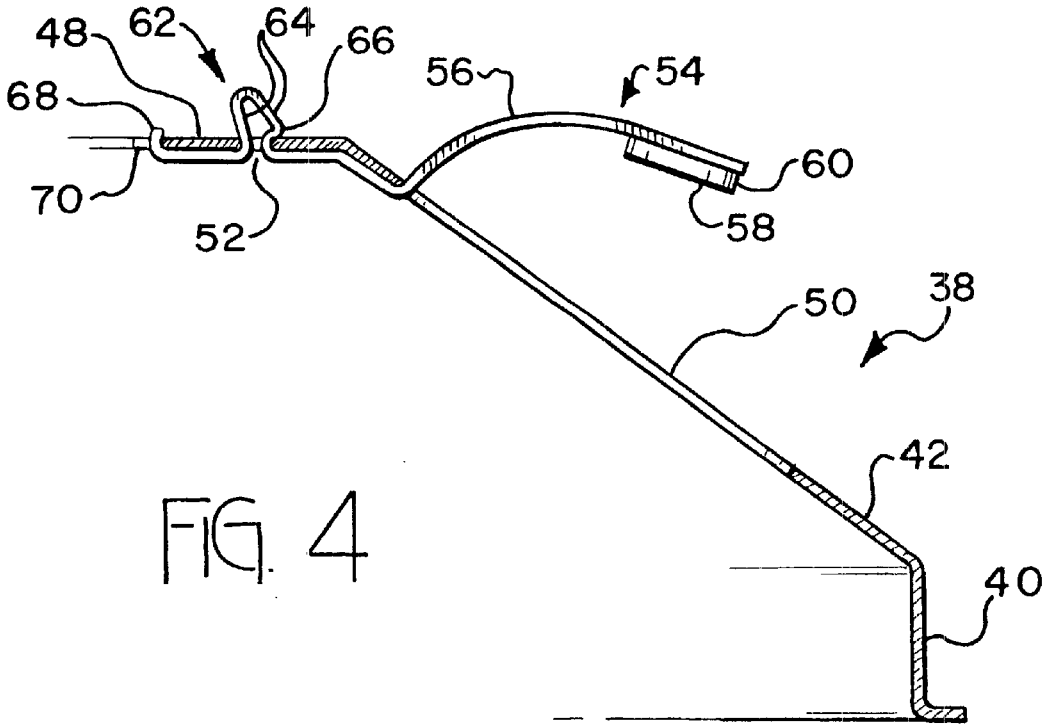
FIG. 4 is an enlarged partially broken-away side view containing a second embodiment of the getter attachment means for attachment to the outside of the IMS of the present invention.

A second exemplary embodiment of the getter attachment assembly 54' is shown in FIG. 4. This embodiment differs from the one shown in FIG. 3 in that the clip 62 is inserted into opening 52 from the underside of the ledge 48. In this embodiment, the shoulder 66 contacts the upper surface of the ledge 48 and the spring 56 extends along the underside of the sidewall 42 and through the aperture 50. The arcuate bend of spring 56 extends the getter 58 beyond the upper surface of the sidewall 42. As shown, the spring 56 is dimensioned to fit between the apertures 50 and openings 52, the spring bias causes the clip 62 to firmly secure within the openings 52 of the IMS 38. Securing the getter attachment assembly 54 to the ledge 48 of the IMS 38 positions the getters 58 out of the yoke field and also makes it possible to reach into the CRT 10 after the neck portion 14 is removed and permit removal and replacement of the getter attachment assembly 54 as needed. It is within the scope of this invention to attach the getter attachment assembly to the mask frame in order to accurately position the getter 48 so as to allow the getter material to be flashed through the apertures 50 and satisfy the requirements for maintaining a suitable low pressure within the evacuated CRT envelope.

In the present invention the openings 52 and notch 70 are formed so as to allow for alignment of the getter attachment assembly 54 along the major axis X—X, or parallel to its wider dimension (usually horizontal), of the CRT 10. The coupling forces described in the embodiments shown in FIGS. 3 and 4 provide stabilization of the getter 58 along the major axis X—X. As the longitudinal dimension of the CRT 10 increases, as in the case of a 16:9 aspect ratio CRT, the placement of the getter 58 along the major axis X—X permits the flashed getter material to reach the increased longitudinal distances and react with the residual gas molecules within the increased area of the CRT 10.

What is claimed is:

1. In a cathode-ray-tube having an evacuated envelope with a minor and major axis and having a funnel being sealed at one end to a faceplate panel with a luminescent screen on an interior surface thereof; a shadow mask assembly disposed within said envelope adjacent said faceplate panel; an internal magnetic shield having sidewalls extending along the wider and narrower dimensions of said tube and forming a front and rear open end, said front open end secured to said shadow mask assembly and comprising: at least one aperture extending through said sidewalls and being open to said major axis along the narrower dimension of said tube; and, at least one getter attachment assembly having a proximal and distal end, said distal end comprising a getter, and said proximal end having a coupling clip for securing said assembly to said internal magnetic shield, wherein said getter is oriented along said major axis so as to deposit a film of evaporated getter material through said aperture toward said major axis.

2. The tube as described in claim 1, wherein said coupling clip further comprises a grasping portion extending away from said distal end and formed to provide a projected corner for contact with the edge of said sidewalls at said rear open end.

3. The tube as described in claim 2 wherein said coupling clip further comprises a V shaped portion located adjacent the gasping portion, the V shaped portion being receivable within an opening formed in said internal magnetic shield proximate said rear open end.

4. A cathode-ray tube having a getter attachment assembly for orienting the deposition of getter material in the envelope of said cathode-ray-tube, said tube having a major axis, a funnel sealed at one end to a faceplate panel with a luminescent screen on an interior surface thereof, a shadow mask assembly disposed within said envelope and in proximity to said screen comprising: an internal magnetic shield secured to said shadow mask assembly, said magnetic shield having sidewalls extending along the wider dimension of said tube and along the narrower dimension of said tube and forming a rear open end and a front open end, said rear open end being defined by a ledge comprising at least one opening, said sidewalls having at least one aperture open to said major axis along the narrower dimension of the tube; and, at least one elongated spring disposed within said envelope having a proximal end secured to said ledge and a distal end, said distal end having a getter for depositing getter material therefrom through said aperture toward the major axis within said envelope.

5. The tube of claim 4, wherein said proximal end includes a coupling clip configured to be detachably attached to said magnetic shield.

6. The tube of claim 4, wherein said internal magnetic shield further comprises at least one notch formed on the edge of said ledge and aligned with at least one opening for accepting said proximal end of said at least one elongated spring.

7. The tube of claim 6, wherein the coupling clip includes a grasping portion extending away from said distal end and formed to provide a projected corner for contact with said notch.

8. The tube of claim 7 wherein the coupling clip further includes a V shaped portion which is insertable into a second opening formed in said internal magnetic shield proximate said at least one opening.

* * * * *